United States Patent [19]

Sletten

[11] Patent Number: 4,724,793

[45] Date of Patent: Feb. 16, 1988

[54] DEVICE FOR PRESSURE FEEDING LIQUID CHEMICALS INTO A WOODEN POLE

[76] Inventor: Steven A. Sletten, Box 153, Binford, N. Dak. 58416

[21] Appl. No.: 904,181

[22] Filed: Sep. 8, 1986

[51] Int. Cl.[4] ..... B05C 5/02

[52] U.S. Cl. ..... 118/35; 47/57.5; 118/410

[58] Field of Search ..... 118/410, 35; 47/57.5

[56] References Cited

U.S. PATENT DOCUMENTS

| | | | |
|---|---|---|---|
| 1,756,453 | 4/1930 | Davey | 47/57.5 |
| 1,999,458 | 4/1935 | Hollister | 47/1 |
| 3,295,254 | 1/1967 | Schoonman | 47/57.5 |
| 3,706,161 | 12/1972 | Jenson | 47/57.5 |
| 3,834,075 | 9/1974 | Nix et al. | 47/57.5 |
| 3,864,874 | 2/1975 | Norris | 47/57.5 |
| 3,968,594 | 7/1976 | Kawakami | 47/57.5 |
| 4,112,617 | 9/1978 | Purviance | 47/57.5 |
| 4,308,689 | 1/1982 | Jenson et al. | 47/57.5 |

*Primary Examiner*—John P. McIntosh

*Attorney, Agent, or Firm*—Zarley, McKee, Thomte, Voorhees & Sease

[57] ABSTRACT

A device for pressure feeding or injecting a liquid chemical such as a fumigant or the like into a wooden pole is described. One form of the invention comprises a plug member having a threaded shank portion and a hexagonal head portion. A longitudinally extending bore extends through the head portion and the shank portion. A one-way check valve is inserted into the outer end of the longitudinally extending bore to provide a means for injecting the liquid chemical into the pole. A bleeder opening is formed in the shank portion which extends outwardly from the longitudinally extending bore to enable air to be discharged therefrom as the liquid chemical is initially injected into the bore. A modified form of the invention is also described.

7 Claims, 5 Drawing Figures

DEVICE FOR PRESSURE FEEDING LIQUID CHEMICALS INTO A WOODEN POLE

BACKGROUND OF THE INVENTION

Wooden poles such as telephone poles or the like sometimes experience internal rot or insect damage. If a pole is inspected and found to have internal rot or decay, the usual method of treating the same is to drill several downwardly extending holes in the pole with the holes then being filled with a fumigant such as that sold under the trademark POLE FUMIGANT by Koppers Company, Inc. of St. Louis, Mo. The active ingredient of the fumigant sold by Koppers Company, Inc. is sodium methal dithiocarbamate (anhydrous). Once the holes have been filled with the fumigant, the holes are either filled with some sort of putty or closed with wooden plugs. If the pole must subsequently be treated, additional holes must be drilled and the additional holes seriously weaken the pole.

It is therefore a principal object of the invention to provide an improved device for pressure feeding or injecting a liquid chemical such as a fumigant or the like into a wooden pole.

A further object of the invention is to provide a device for injecting fumigant or the like into a pole with the device remaining in place in the pole to enable the pole to be subsequently treated without the necessity of drilling additional pole weakening holes.

A further object of the invention is to provide a device for pressure feeding or injecting a liquid chemical into a tree including a bleeder opening to enable air to be expelled from the device as the liquid chemical is being initially injected into the devcie and the pole to prevent the pole from splitting.

These and other objects will be apparent to those skilled in the art.

SUMMARY OF THE INVENTION

One form of the invention comprises a plug member having a threaded shank portion and a hexagonal head portion. A longitudinally extending bore extends through the head portion and the shank portion. The shank portion has external threads provided thereon to enable the plug member to be threadably screwed into an opening formed in the pole. A one-way check valve such as a grease fitting or the like is inserted into the outer end of the longitudinally extending bore to provide a means for injecting the liquid chemical into the pole. A bleeder opening is formed in the shank portion which extends outwardly from the longitudinally extending bore to enable air to be discharged from the longitudinally extending bore as the liquid chemical is initially injected into the bore. A modified form of the invention comprises a plug members which is inserted into an opening formed in the pole. A bolt member is threadably inserted into the plug member and has a longitudinally extending bore formed therein which has a one-way check valve such as a grease fitting or the like mounted in the outer end thereof. A bleeder opening is formed in the bolt member for the same purpose as in the embodiment just described. A gasket or seal is positioned between the head portion of the bolt member and the head portion of the plug member. In both of the embodiments, a protective cap is removably positioned in the outer end of the device to protect the one-way check valve.

DESCRIPTION OF THE PREFERRED EMBODIMENT

Figure 1:
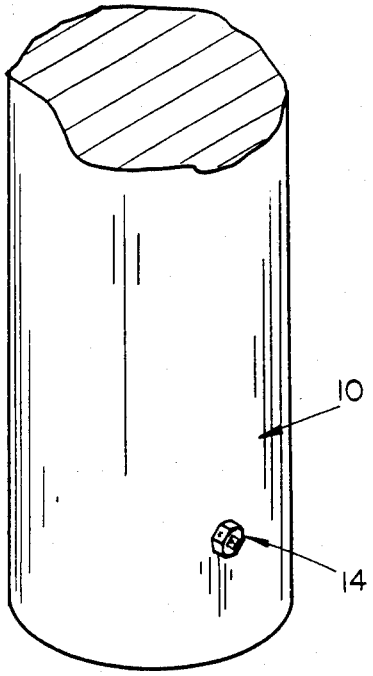
FIG. 1 is a partial perspective view of a wooden pole having the device of this invention mounted therein.
Figure 2:
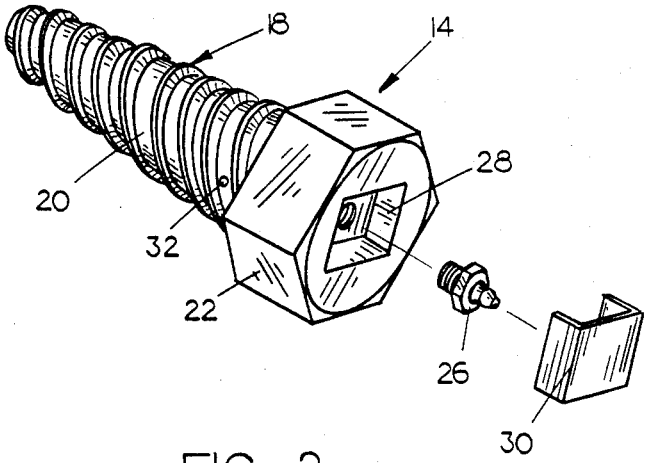
FIG. 2 is an exploded perspective view of one form of the device of this invention.
Figure 3:
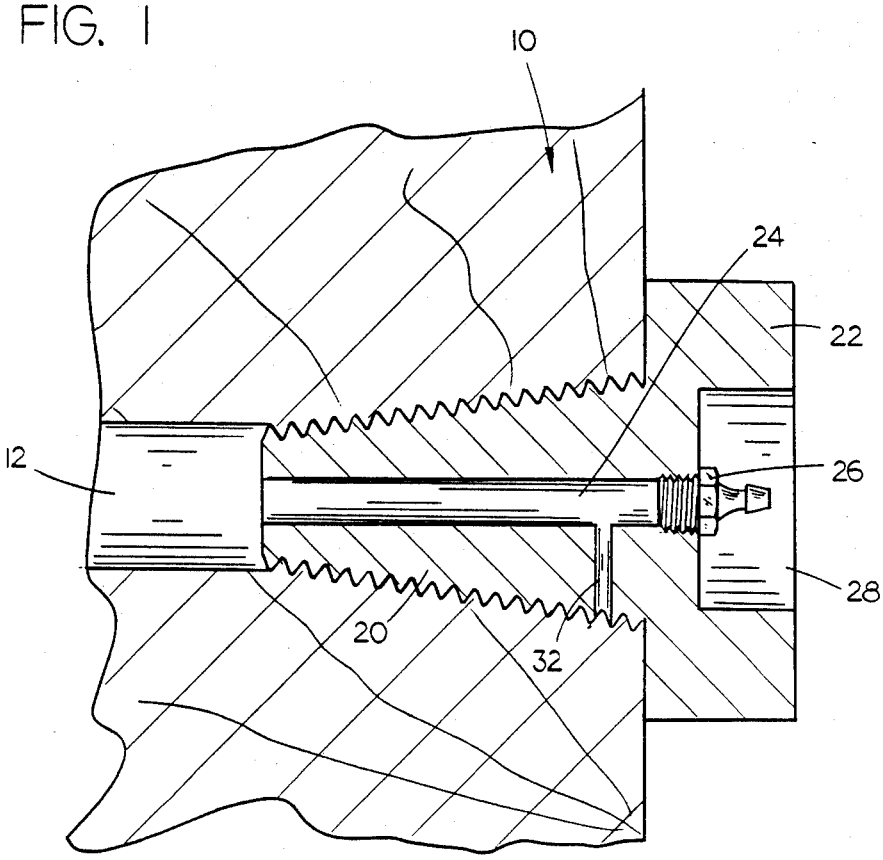
FIG. 3 is a sectional view illustrating the device of FIG. 2 mounted in a wooden pole.
Figure 4:
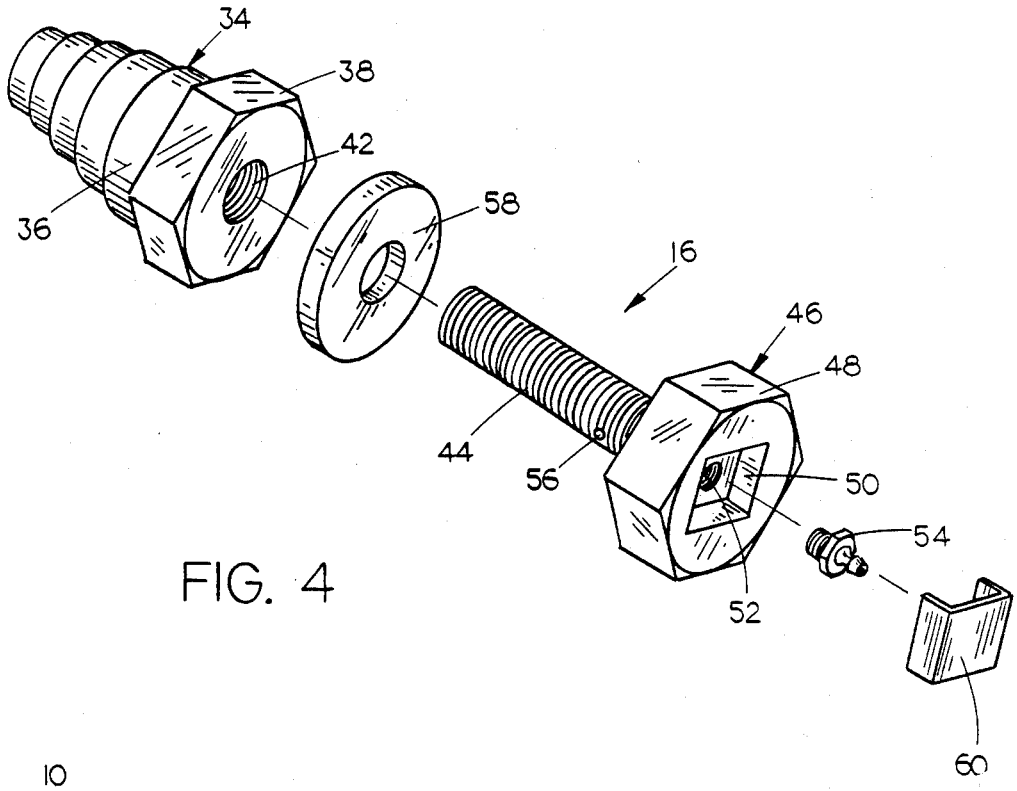
FIG. 4 is an exploded perspective view of a modified form of the device.
Figure 5:
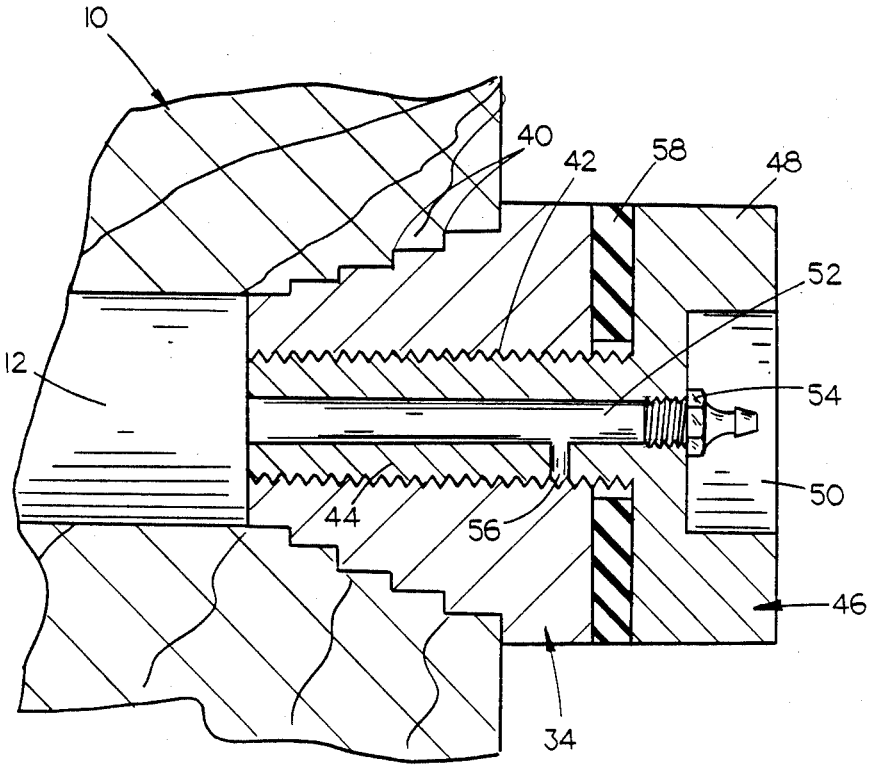
FIG. 5 is a sectional view illustrating the device of FIG. 4 positioned in a wooden pole.

In the drawings, the numeral 10 refers to a wooden pole such as telephone pole or the like having at least one, but normally several openings or bores 12 formed therein if the pole is to be treated for internal rot or insect damage. One form of the invention is illustrated in FIGS. 2 and 3 and is referred to generally by the reference numeral 14. A modified form of the invention is illustrated in FIGS. 4 and 5 and is referred to by the reference numeral 16.

Device 14 comprises a plug member 18 having an externally threaded and tapered shank portion 20 and a hexagonal head portion 22 at one end thereof. A longitudinally extending bore 24 extends through the device as illustrated in FIG. 3 and has a one-way check valve such as a grease fitting 26 threadably mounted in the outer end thereof. As seen in FIGS. 2 and 3, head portion 22 is provided with a recessed opening 28 formed therein in which the fitting 26 is positioned. The numeral 30 refers to a protective cap which may be inserted into the recessed opening 28 as will be described in more detail hereinafter. Bleeder opening 32 is formed in shank portion 20 and extends outwardly from bore 24 closely adjacent head portion 22 as seen in FIG. 3.

When device 14 is used to inject a liquid chemical such as a fumigant into the pole 10, shank portion 20 is inserted into the outer end of the opening 12 and is screwed into the opening 12 until bleeder opening 32 is just slightly positioned within the opening 12. The fumigant is then injected into the bore 24 through the fitting 26. As the fumigant is injected into the bore 24, the air in the bore 24 will pass outwardly through the bleeder opening 32 and will pass outwardly through the outer end of the opening 12. When substantially all of the air has been removed from the bore 24, the device 14 is then screwed into the opening 12 until head portion 22 is closey adjacent the exterior of the pole 10 as illustrated in FIG. 3. Additional fumigant is then injected into the bore 12 through the fitting 26. When sufficient fumigant has been pressure injected into the opening 12, the injector is removed from the fitting 26 and the cap 30 in installed into the opening 28 to protect the fitting 26. The fact that the fitting 26 is utilized during the injection process permits the fumigant or liquid chemical to be injected into the opening under pressure so that the liquid chemical will tend to migrate through the wood. Should it be necessary to re-treat the pole, the cap 30 is removed and additional liquid chemical is injected into the pole without the necessity of additional holes being required.

Device 16 comprises a plug member 34 having a tapered shank portion 36 and a hexagonal head portion 38. Shank portion 36 is either provided with the step shoulder 40 as illustrated in the drawings or exterior threads such as found on device 14. Plug member 34 is provided with an internally threaded opening 42 formed therein which is adapted to receive the threaded shank portion 44 of bolt member 46. Bolt member 46 also includes a hexagonal head portion 48 as seen in the drawings which has a recessed opening 50 formed in the outer end which is identical to recessed opening 28 in device 14. A longitudinally extending bore or passageway 52 is formed in bolt member 46 as seen in FIG. 5 and has a one-way check valve in the form of a grease fitting 54 threadably mounted in the outer end thereof. As seen in FIG. 5, grease fitting 54 is positioned in the recessed opening 50. Shank portion 44 of bolt member 46 has a bleeder opening 56 formed therein which extends outwardly from passageway 52 closely adjacent head portion 48. The numeral 58 refers to a gasket or washer which embraces shank portion 44. Protective cap or cover 60 is adapted to be received in recessed opening 50 to protect grease fitting 54 during periods that the device is not being used.

Device 16 is positioned in the pole by pounding the tapered shank portion 36 of plug member 34 into the outer end of the opening 12. Bolt member 46 is then threadably secured to plug member 34 by threadably inserting shank portion 44 into the threaded opening or bore 42. Shank portion 44 is threaded into the bore 42 until bleeder opening 56 is at the outer end of bore 42. The liquid chemical is then injected into bore 52 to evacute at least some of the air from bore 52 and the opening 12. When sufficient air has been evacuated from the bore 52 and opening 12, bolt member 46 is tightened until the gasket or washer 58 has been compressed as illustrated in FIG. 5.

The desired amount of liquid chemical is then injected into the bore 52 and opening 12 with the same being injected under pressure so that the pressurized liquid chemical will migrate into the fibers of the wood. Once sufficient liquid chemical has been injected into the pole, the injector is removed from the fitting 54 and a protective cover 60 is positioned in the recessed opening 50. Should it ever be necessary to re-treat the pole, cover 60 may be easily removed to provide access to the fitting 54 to eliminate the necessity of drilling additional hole weakening openings in the pole.

Thus it can be seen that novel devices have been provided for treating wooden poles with a liquid chemical such as a fumigant or the like. Not only do the devices of this invention permit the injection of the liquid chemicals into the pole under pressure but eliminate the necessity for drilling additional holes in the pole if the pole must subsequently be re-treated. Thus it can be seen that the invention accomplishes at least all its stated objectives.

I claim:

1. A device for pressure feeding liquid chemicals into a wooden pole, comprising, a plug member including a shank portion and a head portion, said plug member having a longitudinal bore extending completely therethrough which has inner and outer ends, said shank portion adapted to be inserted into a hole drilled in the pole, means on said shank portion for maintaining said plug member in the hole, a one-way check valve means mounted in the outer end of said bore adapted to permit a liquid chemical to be pressure injected into the pole through the plug member and the hole drilled in the pole, and a bleeder opening formed in said shank portion positioned closely adjacent said head portion and extending outwardly from said longitudinal bore, said bleeder opening adapted to permit air in said bore to be evacuated therefrom as the liquid chemical is initially injected into said bore.

2. The device of claim 1 wherein said head portion has an outer end which has a recessed opening formed therein which communicates with the outer end of said bore, said check valve means being positioned in said recessed opening.

3. The device of claim 2 wherein a protective cap means is removably mounted in said recessed opening to protect said check valve means.

4. A device for pressure feeding liquid chemicals into a wooden pole, comprising, a plug member including a shank portion and a head portion, said plug member having a longitudinal bore extending therethrough which has inner and outer ends, said shank portion adapted to be inserted into a hole drilled in the pole, means on said shank portion for maintaining said plug member in the hole, said longitudinal bore being threaded, a bolt member including an externally threaded shank portion and a bolt head at one end thereof, said threaded shank portion adapted to be threadably received by the threaded longitudinal bore, said bolt member having a longitudinally extending passageway formed therein, said passageway having inner and outer ends, a one-way check valve means on the outer end of said passageway, a seal means embracing the shank portion of said bolt member adjacent said bolt head and positioned between said bolt head and said head portion of said plug member, and a bleeder opening formed in said shank portion of said bolt member extending outwardly from said passageway.

5. The device of claim 4 wherein said bleeder opening is positioned closely adjacent said bolt head.

6. The device of claim 4 wherein said bolt head has an outer end which has a recessed opening formed therein which communicates with the outer end of said passageway, said check valve means being positioned in said recessed opening.

7. The device of claim 6 wherein a protective cap means is removably mounted in said recessed opening to protect said check valve means.

* * * * *